US008932073B2

(12) United States Patent
Weickenmeier

(10) Patent No.: US 8,932,073 B2
(45) Date of Patent: Jan. 13, 2015

(54) ELECTRICAL CLIP CONNECTOR, ELECTRICAL CLIP CONNECTION AND ALSO READY-TO-USE ELECTRICAL CABLE

(75) Inventor: Klaus Weickenmeier, Lauf (DE)

(73) Assignee: Robert Bosch GmbH, Stuttgart (DE)

( * ) Notice: Subject to any disclaimer, the term of this patent is extended or adjusted under 35 U.S.C. 154(b) by 91 days.

(21) Appl. No.: 13/877,537

(22) PCT Filed: Sep. 30, 2011

(86) PCT No.: PCT/EP2011/067113
§ 371 (c)(1),
(2), (4) Date: Apr. 3, 2013

(87) PCT Pub. No.: WO2012/045675
PCT Pub. Date: Apr. 12, 2012

(65) Prior Publication Data

US 2013/0210259 A1 Aug. 15, 2013

(30) Foreign Application Priority Data

Oct. 4, 2010 (DE) ..... 10 2010 041 931

(51) Int. Cl.
*H01R 4/50* (2006.01)
*H01R 13/639* (2006.01)
(Continued)

(52) U.S. Cl.
CPC ..... *H01R 13/639* (2013.01); *H01R 13/6273* (2013.01); *H01R 13/64* (2013.01); *H01R 2103/00* (2013.01)
USPC ..... 439/345

(58) Field of Classification Search
CPC ..... H01R 13/6275; H01R 13/65802
USPC ..... 439/345, 358, 357, 327, 567, 939
See application file for complete search history.

(56) References Cited

U.S. PATENT DOCUMENTS 2,753,536 A 7/1956 Hugo
5,454,729 A 10/1995 Wen-Te
(Continued)

FOREIGN PATENT DOCUMENTS

DE 20216030 2/2003
JP 58034372 3/1983
(Continued)

OTHER PUBLICATIONS

International Search Report for Application No. PCT/EP2011/067113 dated Dec. 30, 2012 (3 pages).

*Primary Examiner* — Phuongchi T Nguyen
(74) *Attorney, Agent, or Firm* — Michael Best & Friedrich LLP

(57) ABSTRACT

The invention relates to an electrical clip connector for an electrical connection of a cable (20) to an electrical mating connector, in particular to an electrical connection device of a controller for an electric motor of a cooling fan, wherein the clip connector (100) has a holder section (110) and a fastening section (120), and at least one electrical line (200) of the cable (20) can be provided in the holder section (110) in such a way that an electrical contact device (210) of the line (200) projects freely from said holder section, and the clip connector (1) can be fitted to the connection device by means of the fastening section (120). The invention also relates to an electrical clip connection having an electrical clip connector (100) and an electrical mating connector, in particular an electrical connection device of an electrical/electronic device, wherein an electrical contact device (210), in particular a flat plug sleeve (210) or a socket contact, of the clip connector (100) can be accommodated and is accommodated in the mating connector by way of a circumferential section in at least two steps in a successively more interlocking manner when the clip connection comprising the clip connector (100) and the mating connector is established. The invention also relates to a ready-to-use electrical cable (20), in particular for electrically connecting a controller (3) to an electric motor (2) of a cooling fan, having an electrical clip connector (100) according to the invention.

18 Claims, 5 Drawing Sheets

(51) Int. Cl.

| | |
|---|---|
| ***H01R 13/627*** | (2006.01) |
| *H01R 13/64* | (2006.01) |
| *H01R 103/00* | (2006.01) |

(56) References Cited

U.S. PATENT DOCUMENTS

| | | | | |
|---|---|---|---|---|
| 6,939,161 | B1 | 9/2005 | Yi et al. | |
| 7,040,931 | B1 | 5/2006 | Achtner et al. | |
| 7,219,404 | B2 * | 5/2007 | Haga et al. | 24/458 |
| 7,695,305 | B1 | 4/2010 | Ray et al. | |
| 8,804,354 | B2 * | 8/2014 | Golko et al. | 361/756 |
| 2003/0209361 | A1 | 11/2003 | Sivertsen | |
| 2008/0299824 | A1 * | 12/2008 | Legg | 439/595 |
| 2013/0210259 | A1 * | 8/2013 | Weickenmeier | 439/345 |
| 2014/0057479 | A1 * | 2/2014 | Weber et al. | 439/357 |
| 2014/0069713 | A1 * | 3/2014 | Golko et al. | 174/650 |

FOREIGN PATENT DOCUMENTS

| | | |
|---|---|---|
| JP | 04069875 | 6/1992 |
| JP | 2002110277 | 4/2002 |
| JP | 2005006413 | 1/2005 |

* cited by examiner

ELECTRICAL CLIP CONNECTOR, ELECTRICAL CLIP CONNECTION AND ALSO READY-TO-USE ELECTRICAL CABLE

BACKGROUND OF THE INVENTION

The invention relates to an electrical clip connector for an electrical connection of a cable to an electrical mating connector, in particular to an electrical connection device of a control unit for an electric motor of a cooling fan. The invention further relates to an electrical clip connection having an electrical clip connector and an electrical mating connector, in particular an electrical connection device of an electrical/electronic unit. The invention also relates to a ready-to-use electrical cable, in particular for electrically connecting a control unit to an electric motor of a cooling fan.

A large number of electrical pin or male connectors and socket connectors, which are usually referred to as (electrical) plug connectors and are used to transfer electrical voltages, currents and/or signals with the greatest possible range of voltages, currents, frequencies and data rates, are known in the field of electronics and electrical engineering. In particular in the automotive field, such plug connectors and also mating connectors thereof have to lastingly ensure faultless transfer of signals and electrical power in dirty, moist and/or chemically aggressive environments, wherein great value is placed on tightness with respect to harmful media. Due to a wide range of applications for plug connections, a large number of specially designed plug connectors are known. Such plug connectors are often of complicated design, are constructed in a more complex manner in a number of parts and are accordingly costly to produce and equip with electrical contact devices.

SUMMARY OF THE INVENTION

The object of the invention is to specify an alternative to an electrical plug connector, in particular for an electrical connection of a cable or a line to an electrical or electronic unit. Here, the connector according to the invention is to be less complex than a comparable plug connector, it is to be producible in a cost-effective manner and easy to handle. Furthermore, in particular if the connector according to the invention is applied to a control-unit-side electrical connection of a control unit to an electric motor of a cooling fan, it is to be possible to dispense with an additional seal between the connector according to the invention and the control unit.

The object of the invention is achieved by means of an electrical clip connector for an electrical connection of a cable to an electrical mating connector, in particular to an electrical connection device of a control unit for an electric motor of a cooling fan; by means of an electrical clip connection having an electrical clip connector and an electrical mating connector, in particular an electrical connection device of an electrical/electronic unit; and a ready-to-use electrical cable, in particular for electrically connecting a control unit to an electric motor of a cooling fan.

The electrical clip connector according to the invention comprises a holder portion and a fastening portion. An electrical cable or at least one electrical line can be provided at the holder portion in such a way that an electrical contact device of a line of the cable or of the line protrudes freely from the holder portion. The clip connector can be fastened to the connection device by means of the fastening portion, where necessary by means of support of the holder portion. The electrical clip connection according to the invention then accordingly comprises an electrical clip connector and an electrical mating connector. When establishing the clip connection formed of the clip connector and the mating connector, a peripheral portion of an electrical contact device of the clip connector can be received successively with an interlocking fit in the mating connector in at least two steps. The contact device is preferably a flat plug sleeve or a socket contact. Other contact devices can of course also be used however.

The alternative to a conventional plug connector, that is to say the clip connector according to the invention, is less complex than a comparable plug connector, wherein the clip connector can perform similar tasks to a plug connector. In accordance with the invention, a complex plug housing is replaced here by the simply structured clip connector. The clip connector can thus be produced cost effectively, can be equipped easily and quickly, and can be easily handled. Furthermore, it is possible to dispense with an additional seal between the connector according to the invention and an electrical or electronic unit, such as a control unit for a cooling fan of a motor vehicle. A risk of failure of an electrical contact is thus minimized since a sealing point and therefore also a seal is omitted.

In embodiments of the invention the mating connector has an individual receiving chamber for an individual contact device of the clip connector. In this case, the receiving chamber in question of the mating connector preferably has a tubular design, at least internally, into which a seal can be advanced inwardly in addition to the electrical contact device when establishing the clip connection. Here, the seal may sit on the line and/or may be fastened to the clip connector; the seal is preferably provided between the clip connector and the contact device, wherein the contact device holds the seal on the line, preferably by means of crimping. The individual receiving chamber also preferably has at least two centering devices for centering the contact device.

In preferred embodiments of the invention the clip connector has a U-shaped cross section, a U-shaped cross section with one short leg, or an L-shaped cross section. In this case, the fastening portion(s) forms a leg or form the legs, and the holder portion forms a web of the aforementioned cross sections. In particular, the fastening portion(s) and the holder portion, that is to say the clip connector, are formed in one piece, preferably materially in one piece. It is of course also possible to design the clip connector in a number of parts and to provide metal fastening portions, such as metal spring clips, for example on a holder portion made of plastic. A main body of the holder portion may be substantially plate-shaped, wherein the holder portion has a recess, in particular a continuous recess, in which the electrical line and/or the electrical contact device can be assembled. The main body of the holder portion may also have a line holder, by means of which the line can additionally be fixed to the holder portion or the clip connector.

The fastening portion can be formed as a spring clip, wherein the clip connector can be clipped to/onto the mating connector by means of the spring clip, the holder portion and/or a second spring clip or a second fastening portion of different design. The fastening portion preferably protrudes from the holder portion approximately at a right angle, wherein preferably two fastening portions protrude from the holder portion in this way. Here, the two fastening portions may be of different lengths or of equal length and/or one or both fastening portions may be formed as spring clips. In particular at its holder portion, the clip connector may have a spring device, preferably a bow spring, by means of which the clip connector can be pressed in its assembled position at/on the mating connector against a direction of insertion, in which the contact device can be advanced into the receiving chamber of the mating connector.

In preferred embodiments of the invention the fastening portion has a latching device, in particular a latching shoulder, by means of which the clip connector can be latched to a latching device, in particular a latching protrusion of the mating connector. Furthermore, a fastening portion may have a coding, which in particular is formed as a coding protrusion. Here, this coding can be formed at a free end or a free longitudinal end portion of the fastening portion.

BRIEF DESCRIPTION OF THE DRAWINGS

The invention will be explained in greater detail hereinafter on the basis of exemplary embodiments with reference to the accompanying drawing. In the detailed figures of the drawing.

DETAILED DESCRIPTION

The invention will be explained in greater detail hereinafter primarily when applied to a control-unit-side electrical clip connection between a control unit and an electric motor of an engine cooling fan for a motor vehicle. The invention is of course not limited to such an electrical connection, but in principle can be used wherever plug connections are applied. Such fields of application are preferably those where the corresponding electrical connection is easily accessible and the connection is a manufacturer-specific connection, that is to say a connection that in principle is not specified by an external third party.

Figure 1:
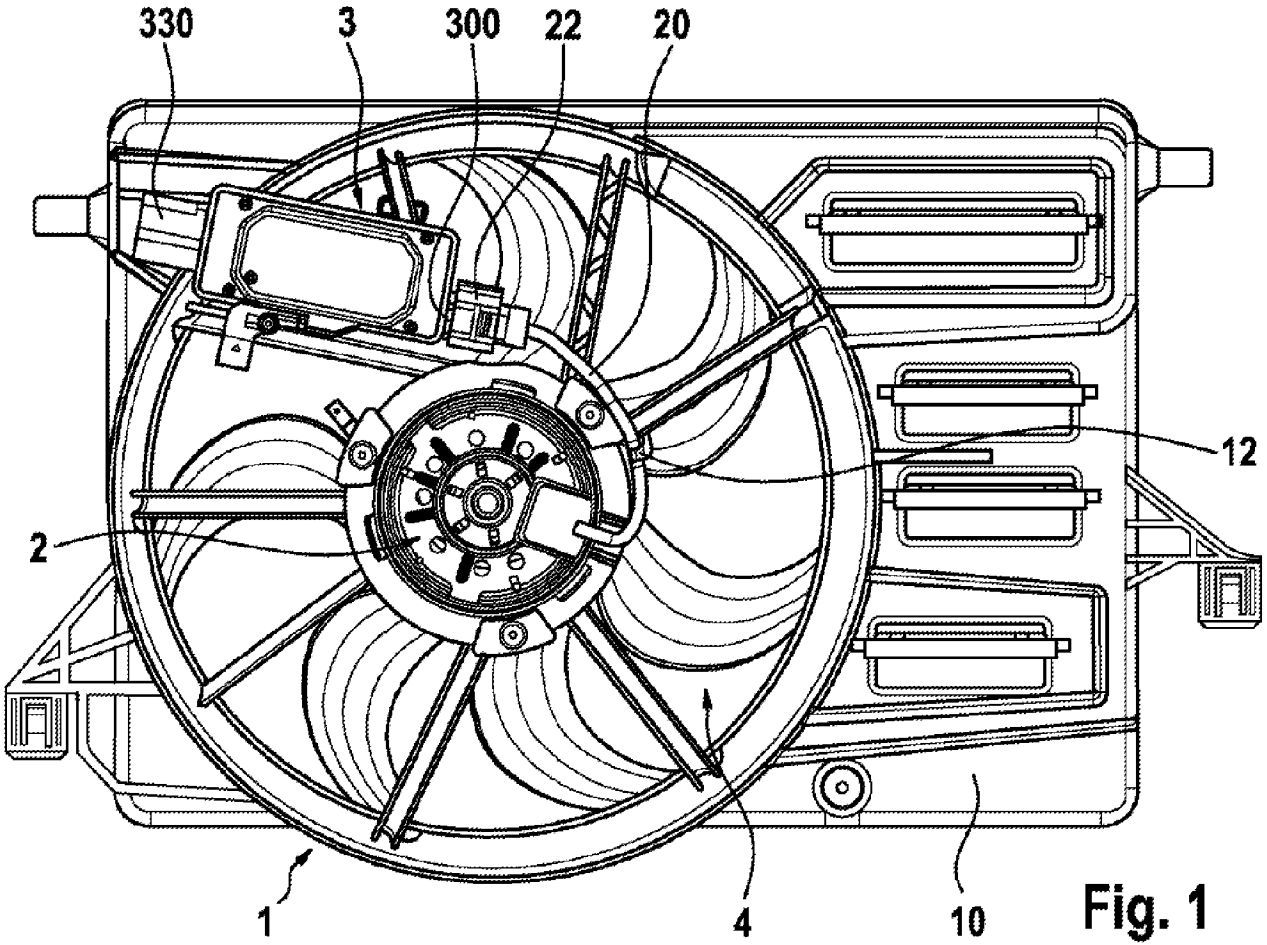
Fig. 1 Prior art
FIG. 1 shows a perspective view from the end face of an engine cooling fan according to the prior art for a motor vehicle.

FIG. 1 shows an engine cooling fan for a motor vehicle, based on a frame 1 with a frame plenum 10. An electric motor or fan motor 2 is assembled centrally on/at the plenum 1 and is actuated by a control unit 3, which is likewise assembled at the plenum 1. The fan motor 2 drives a fan 4, which transports cooling air axially during operation. The fan motor 2 is connected by an electrical cable 20 to the control unit 3, wherein the cable 20 or electrical lines 200 thereof is/are additionally held by a fastening hook 12 at the plenum 1 where necessary. A cable 20 is to be understood to mean a plurality of combined electrical lines 200; if, by contrast, just a single line 200 is provided, reference can therefore be made to a cable 20 nevertheless.

The control unit 3 preferably has two electrical connections 300, 330, specifically an electrical connection device 300 or a plug connection 300 for the cable 20, also referred to hereinafter as a mating connector 300, and a consumer-side plug connection 330, likewise formed as an electrical connection device 300. For connection of the cable 20 to the mating connector 300, said cable in the prior art has a costly, multi-part electrical plug connector 22 of relatively complicated structure. To establish the plug connection, the plug connector 22 is fitted onto/into a two-pin plug contour (mating connector 300) with flat plug tongues of the control unit 3, wherein the plug connector 22 has to be sealed with respect to the plug contour, and the lines 200 of the cable 20 also have to be sealed with respect to the plug connector 22.

Figure 2:
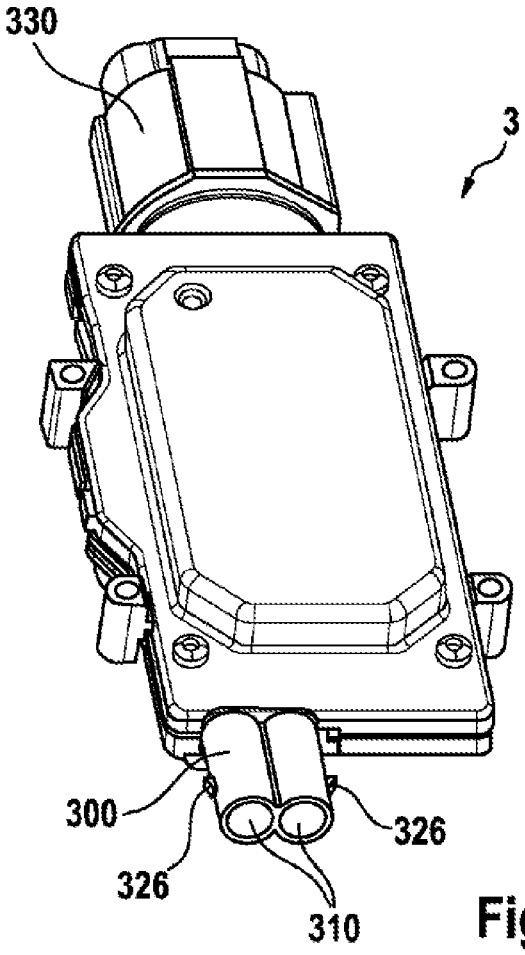
FIG. 2 shows a perspective view of a control unit of an engine cooling fan with an electrical connection device according to the invention.

In accordance with the invention the above plug contour is omitted and the two electrical contact devices 312 of the control unit 3 or of the mating connector 300 formed as flat plug tongues 312 (see FIGS. 7 and 8) are each provided in a receiving chamber 310, which is designed preferably in a tubular manner, at least internally; see FIG. 2. Here, the receiving chambers 310 are provided separately and do not contact one another. Externally, these receiving chambers 310 provided externally on a housing of the control unit 3 are likewise formed in a tubular manner. Instead of flat plug tongues 312, other contact devices 312 can of course also be applied, and these may be a male or pin contact for example. A latching device 326, in particular a latching protrusion 326 or latching hook 326, is located laterally externally on the receiving chambers 310, that is to say laterally on the mating connector 300.

Figure 3:
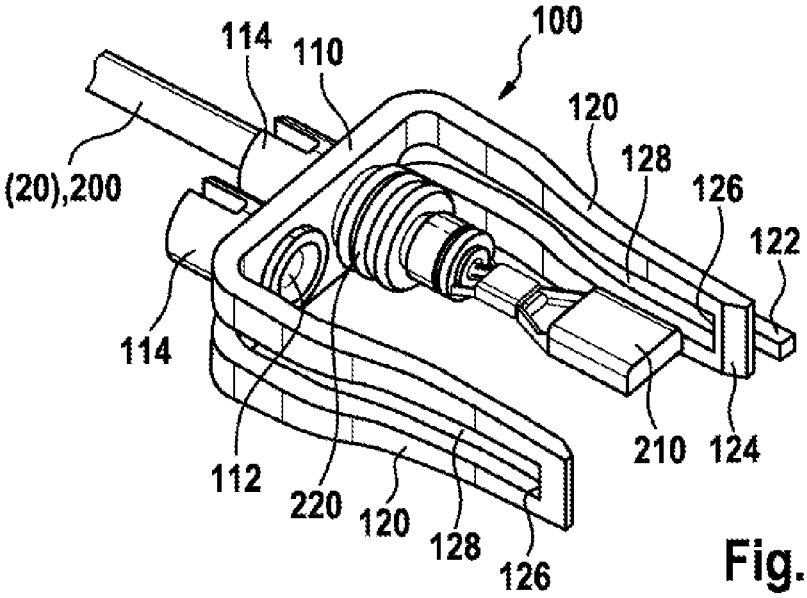
FIG. 3 shows a perspective view of a first embodiment of a clip connector according to the invention for electrically connecting a cable to the connection device of the control unit.

FIG. 3 shows an electrical clip connector 100 according to the invention, by means of which the contact devices 312 of the mating connector 300 can be electrically contacted by electrical contact devices 210, in particular flat plug sleeves 210, of the clip connector 100. Here, the clip connector 100 is formed in a bracket-shaped or U-shaped manner, wherein the two legs of equal length of this U-shaped profile form two fastening portions 120, which are preferably formed as spring clips 210. The two fastening portions 120 are connected via a substantially plate-shaped holder portion 110 at/in which the lines 200 of the cable 20 can be received. For this purpose, the holder portion 110 has one recess 112 per line 200, in particular a continuous recess 112, in which the line 200 is received. On a side opposite the fastening portions 120, the holder portion 110 further has a line holder 114, in which the relevant line 200 can additionally be clamped or held.

The respective line 200 is fitted through the relevant continuous recess 112, wherein the contact devices 210 formed in the present case as flat plug sleeves 210 are provided on an inner face of the clip connector 100, that is to say between the fastening portions 120. (Only one contact device 210 is illustrated in FIG. 3 however.) A seal 220, of which the outer diameter is matched to an inner diameter of the relevant receiving chamber 310, is provided between the flat plug sleeve 210 and the holder portion 110 and seals the line 200 in a fluid-tight manner with respect to the receiving chamber 310 or the mating connector 300. Opposite the seal 220, the line 200 is held or clamped by the preferably butt-shaped and slitted line holder 114; movements of the line 200 then do not propagate to the contact device 210 or only barely propagate to the contact device 210.

The fastening portions 120 are preferably each provided with a continuous slit 128 substantially over their entire length; only at their longitudinal end or longitudinal end portion are the fastening portions 120 closed, wherein a latching device 126, in particular a latching shoulder 126 or latching area 126, is provided internally at the continuous slit 128 and is formed correspondingly to the latching device 326 of the mating connector 300. Furthermore, the continuous slit 128 may extend into the holder portion 110. It is also possible however to omit the continuous slit 128 and to provide latching hooks as a latching device 126 at the respective longitudinal end of the fastening portions 120; in this case it is preferable for the latching devices 326 of the mating connector 300 to be formed as latching recesses.

It is also possible to form the two fastening portions 120 with different lengths (not illustrated in the drawing); with such an embodiment there is then no need for a coding 122 (see below). In this case, the shorter fastening portion 120 may have a latching hook as a latching device 126 and, correspondingly thereto, the mating connector 300 may have a latching recess. The other fastening portion 120 can be formed here as described above. Furthermore, it is possible to provide just one individual fastening portion 120 at the holder portion 100. The holder portion 110 then has a fastening device, for example a latching device, at a free end opposite the single fastening portion 120 and can be fastened to the mating connector 300 by means of said fastening device.

In order to ensure an electrical connection, which is protected against reverse voltage, between the clip connector 100 and the mating connector 300, the clip connector 100 may have a coding 122, for example in the form of a coding protrusion 120, preferably at a free end of a fastening portion 120. Correspondingly hereto, the mating connector 300 or the housing of the control unit 3 has a recess. The coding protrusion 120 is dimensioned here in such a way that the clip connector 100 cannot be clipped to the mating connector 300 if fitted in an incorrectly oriented manner. Furthermore, the fastening portion 120 may have at its free end an assembly bevel 124, by means of which it is made easier to move the free end of the fastening portion 120 over the relevant latching hook 326 of the mating connector 300.

Figure 4:
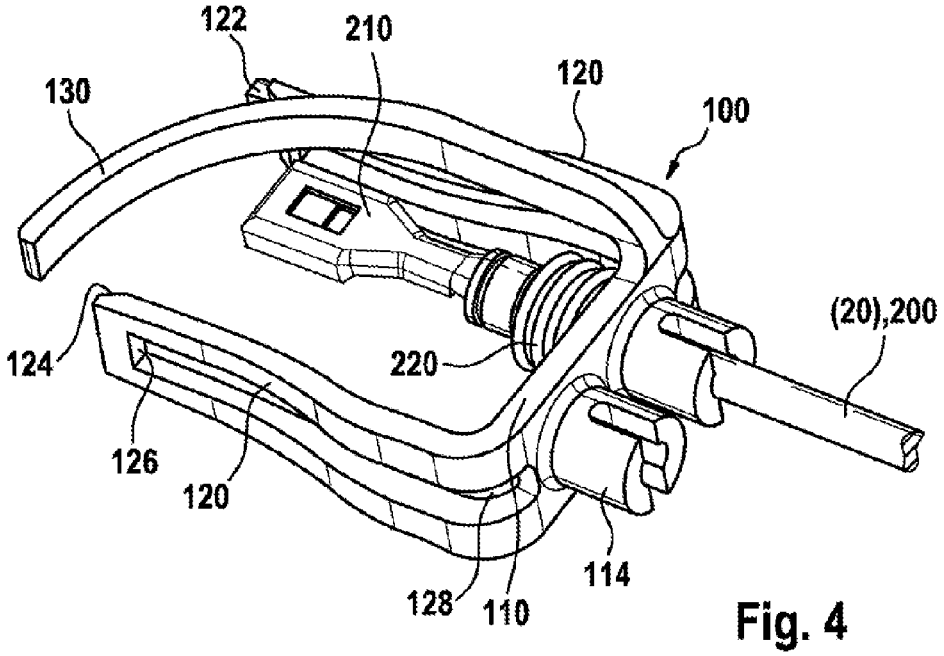
FIG. 4 shows a three-dimensional view diagonally from above of a second embodiment of the clip connector according to the invention.
Figure 5:
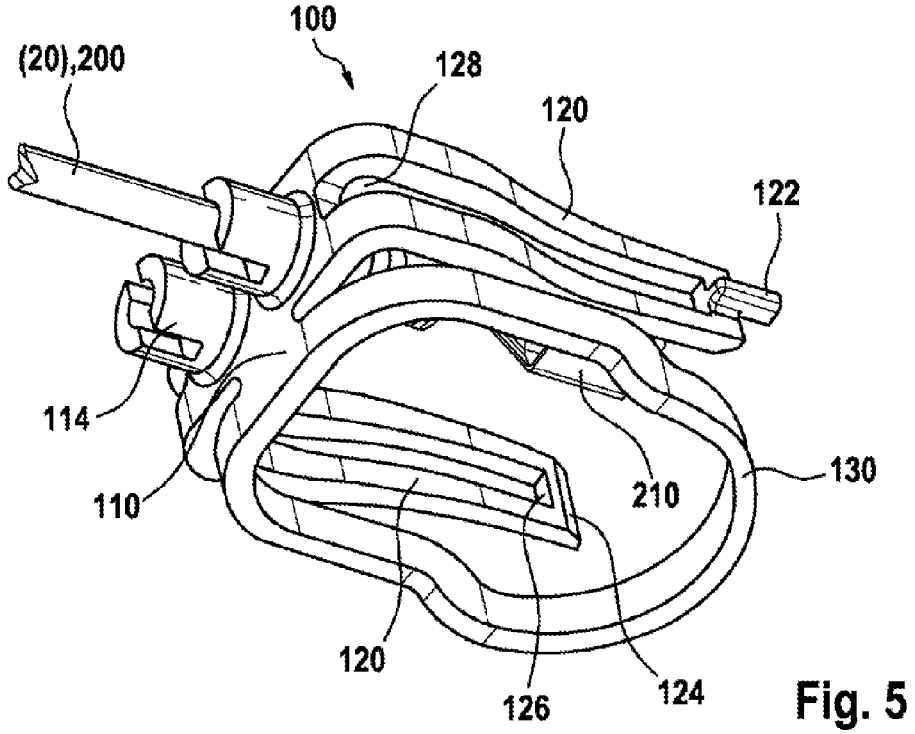
FIG. 5 shows a three-dimensional view diagonally from below of a third embodiment of the clip connector according to the invention.

In order to ensure reliable clipping or latching in the clip connector 100 at the mating connector 300, the clip connector 100 may have a spring device 130, preferably a bow spring 130. In this case, FIG. 4 shows an open bow spring 130 preferably provided materially in one piece above on the holder portion 110, and FIG. 5 shows a closed bow spring 130 preferably provided materially in one piece underneath on the holder portion 110. The respective bow spring 130 presses an incorrectly clipped clip connector 100 away from the mating connector 300 in such a way that electrical contact is no longer possible. In other words, the incorrectly placed clip connector 100 is noticed at the latest during a test run of the engine cooling fan. In this case, the bow spring 130 is supported at the mating connector 300 or the housing of the control unit 3 at an end face or at a protrusion.

Figure 6:
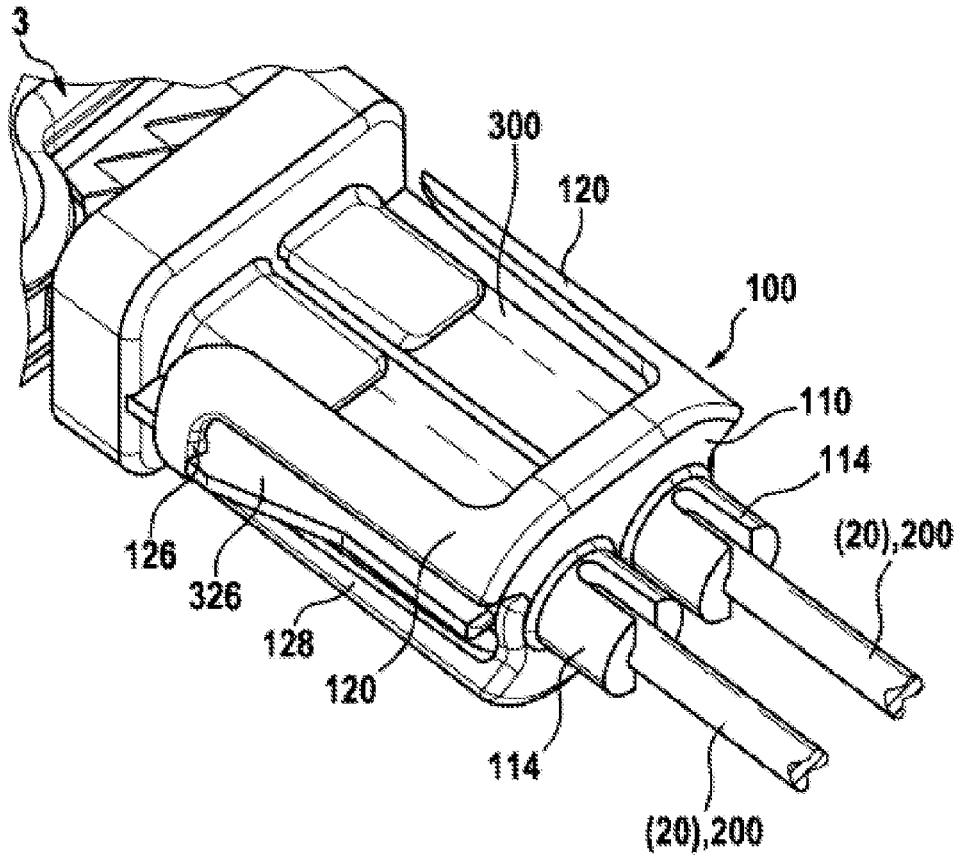
FIG. 6 shows a perspective view of a fourth embodiment of a clip connector according to the invention in a state clipped onto a connection device of an electrical or electronic unit.

FIG. 6 shows a further embodiment of the clip connector 100 according to the invention, but in a state clipped onto a connection device 300 or a mating connector 300 of an electrical or electronic unit 3. In this case, the fastening portions 120 are formed in such a way that they partly surround the tubular formation of the mating connector 300, that is to say they are formed as part of a circle or part of an ellipsis in cross section. Furthermore, the holder portion 110 is designed in such a way that it reaches beyond an end face of the mating connector 300, at least above and underneath (with reference to FIG. 6); in other words, it is formed at least in part as a trough that is not too deep. As a result of these measures, the clip connector 100 sits securely on the mating connector 300. In other words, the clip connector 100 sits with an interlocking fit on the mating connector, which also applies to above embodiments.

Figure 7:
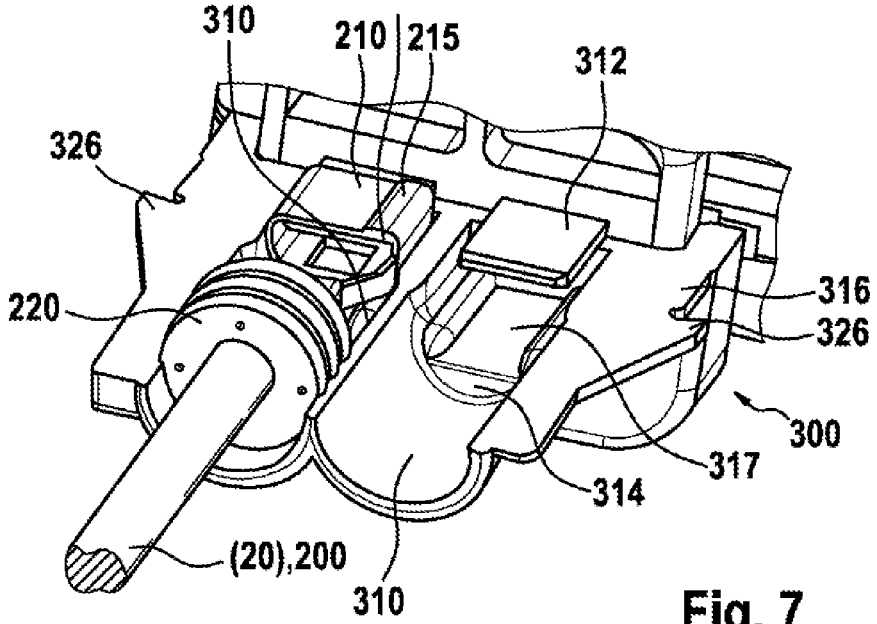
FIG. 7 shows a perspective and cut-away view from below of the receipt of an electrical contact device in the connection device from FIG. 6 with an at least partly interlocking fit.
Figure 8:
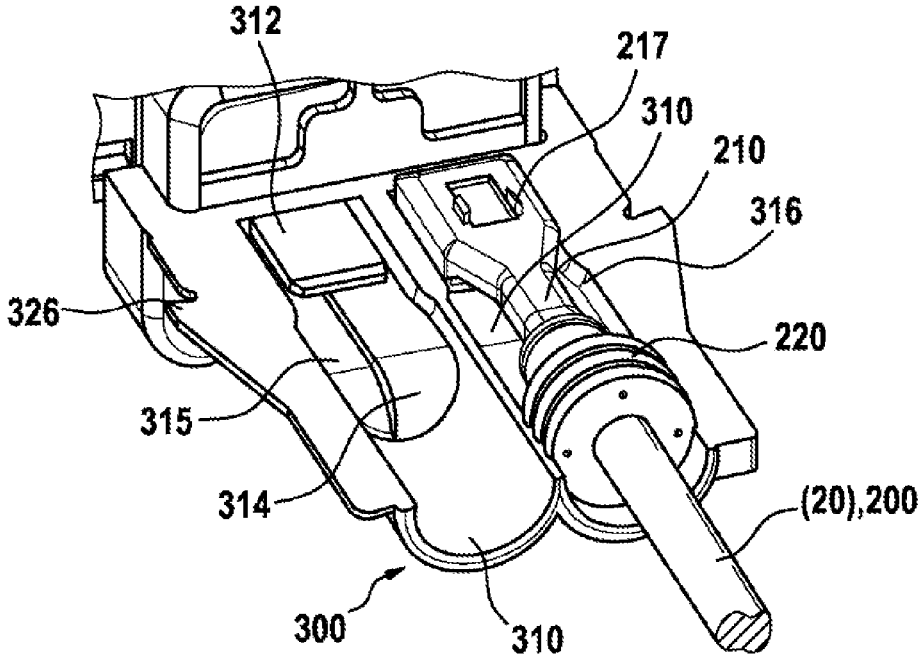
FIG. 8 shows a perspective and cut-away plan view of the receipt of the contact device in the connection device from FIG. 6 with an at least partly interlocking fit.

With reference to FIGS. 7 and 8, a clipping or latching of the clip connector 100 to the mating connector 300 will now be explained in greater detail. The clip connector is moved toward the mating connector 300 via its two electrical contact devices 210 (only a single contact device 210 is illustrated in FIGS. 7 and 8 for the sake of clarity), wherein each contact device 210 is advanced into an individual receiving chamber 310. Reference will be made hereinafter to just a single contact device 210; the principle can be applied analogously to the second contact device 210. During the advancing process, the contact device 210, if not arranged precisely enough with respect to the holder portion 110, is correctly oriented, that is to say turned, due to centering devices 314, 315, 316, 317, which are provided in the receiving chamber 310. Furthermore, the contact device 210 is positioned vertically and horizontally with reference to FIGS. 7 and 8 in such a way that it can properly electrically contact the contact device 312 of the mating connector 300.

The contact device 210 is guided in a forced manner due to the geometry of the receiving chamber 310, in particular due to the centering devices 314, 315, 316, 317, in such a way that either correct electrical contact is produced between the contact devices 210, 312, or the clipped connection between the clip connector 100 and the mating connector 300 cannot be established. The contact device 312 is positioned vertically by means of preferably two mutually opposed centering devices 314, which are preferably formed as centering bevels 314 or insertion bevels 314. In this case, a centering protrusion 215 on the contact device 210 can slide along in a centering groove 315, whereby a horizontal and vertical position of the contact device 210 is further set. Furthermore, preferably mutually opposed centering devices 316, which are preferably likewise formed as centering bevels 316 or insertion bevels 316, are used to horizontally position the contact device 210. It is of course possible to design the receiving chamber 310 in such a way that a single centering device 314, 315 is sufficient in each case.

It is also preferable for the contact device 210 to have at least one centering tab 217 on a side opposite the centering protrusion 215, said centering tab centering the contact device 210 in the receiving chamber 310 in a centering device 317, in particular a centering groove 317. Two centering tabs 217 spaced parallel to one another are preferably provided and can engage the centering groove 317 laterally. In this case, the at least one centering tab 217 and the centering protrusion 215 and the centering devices 314, 315, 316, 317 of the receiving chamber 310 are arranged in such a way that the centering process takes place in steps and, in addition, the contact device 210 is centered before the contacting of the contact device 312 in such a way that faultless electrical contacting is possible. Here, the centering devices 314, 316 center the contact device 210 at the broad and narrow planar longitudinal sides thereof respectively, that is to say initially at the leading edges of these sides.

When establishing the electrical contacting between the two contact devices 210, 312, the longitudinal end portions of the fastening portions 120 move away laterally from the mating connector 300 due to the preferably tapered latching hooks 326. If the electrical contacting is produced, the latching areas 126 of the fastening portions 120 thus latch at the latching areas of the latching hooks 326.

The invention claimed is:

1. An electrical clip connector for an electrical connection of a cable (20) to an electrical mating connector (300), wherein the clip connector (100) has a holder portion (110), two flexible fastening portions (120) and a spring device (130) that extend from and are integrally formed in one piece with the holder portion (110), and the spring device (130) presses the clip connector (100) away from the electrical mating connector (300) when the clip connector (100) is incorrectly clipped to the mating connector (300), wherein at least one electrical line (200) of the cable (20) can be provided at the holder portion (110) in such a way that an electrical contact device (210) of the line (200) protrudes freely from the holder portion, and the clip connector (1) can be assembled on the electrical mating connector (300) via the fastening portions (120).

2. The electrical clip connector as claimed in claim 1, characterized in that the clip connector (100) has a U-shaped cross section, a U- shaped cross section with one shorter leg, or an L-shaped cross section, wherein the fastening portions (120) form legs of the cross section and the holder portion (110) forms a web of the cross section.

3. The electrical clip connector as claimed in claim 1, characterized in that the holder portion (110) has a recess (112), in which the electrical line (200) and/or the electrical contact device (210) can be assembled.

4. The electrical clip connector as claimed in claim 1, characterized in that the fastening portions (120) are formed as spring clips (120), wherein the clip connector (100) can be clipped to the mating connector (300) via the spring clips (120) and/or the holder portion (110).

5. The electrical clip connector as claimed in claim 1, characterized in that the fastening portions (120) protrude from the holder portion (110) approximately at right angles, wherein the two fastening portions (120) are of different lengths or of equal length and/or one or both fastening portions (120) is/are formed as spring clips (120).

6. The electrical clip connector as claimed in claim 1, characterized in that via the spring device (130), the clip connector (100) can be pressed in its assembled position on the mating connector (300) against a direction of insertion, in which the electrical contact device (210) can be advanced into a receiving chamber (310) of the mating connector (300).

7. The electrical clip connector as claimed in claim 1, characterized in that the fastening portions (120) have latching devices (126) via which the clip connector (100) can be latched to a latching device (326) of the mating connector (300).

8. A ready-to-use electrical cable, in particular for electrically connecting a control unit (3) to an electric motor (2) of a cooling fan, characterized in that the ready-to-use electrical cable (20) has an electrical clip connector (100) as claimed in claim 1.

9. The electrical clip connector as claimed in claim 1, characterized in that a main body of the holder portion (110) is substantially plate-shaped, and the holder portion (110) has a continuous recess (112) in which the electrical line (200) and/or the electrical contact device (210) can be assembled, and the main body of the holder portion (110) also has a line holder (114) via which the line (200) can additionally be fixed to the holder portion (110).

10. The electrical clip connector as claimed in claim 1, characterized in that the spring device (130) is a bow spring.

11. The electrical clip connector as claimed in claim 1, characterized in that the fastening portion (120) has a latching shoulder (126) via which the clip connector (100) can be latched to a latching protrusion (326) of the mating connector (300), and at least one of the fastening portions (120) has a coding (122), which is formed as a coding protrusion (122), wherein the coding (122) is formed at a free end or a free longitudinal end portion of the fastening portion (120).

12. An electrical clip connection having an electrical clip connector (100) and an electrical mating connector (300), wherein the clip connector (100) has a holder portion (110), and two flexible fastening portions (120) and a spring device (130) that extend from and are integrally formed in one piece with the holder portion (110), and the spring device (130) presses the clip connector (100) away from the electrical mating connector (300) when the clip connector (100) is incorrectly clipped to the mating connector (300), when establishing the clip connection formed of the clip connector (100) and the mating connector (300), a peripheral portion of an electrical contact device (210) or a socket contact, of the clip connector (100) can be received and is received successively with an interlocking fit in the mating connector (300) in at least two steps.

13. The electrical clip connector as claimed in claim 12, characterized in that the clip connector (100) has a U-shaped cross section, a U-shaped cross section with one shorter leg, or an L-shaped cross section, wherein the fastening portions (120) form the legs of the cross section and the holder portion (110) forms a web of the cross section.

14. The electrical clip connection as claimed in claim 13, characterized in that the electrical mating connector (300) has an individual receiving chamber (310) for an individual electrical contact device (210), wherein the individual receiving chamber (310) has at least two centering devices (314, 315, 316, 317) for centering the contact device (210).

15. The electrical clip connection as claimed in claim 14, characterized in that the individual receiving chamber (310) of the electrical mating connector (300) has a tubular design, at least internally, into which a seal (220) can also be advanced inwardly in addition to the electrical contact device (210) when establishing the clip connection.

16. An electrical clip connection having an electrical clip connector (100) and an electrical mating connector (300) of an electrical/electronic unit (3), characterized in that, the clip connector (100) has a holder portion (110), and two flexible fastening portions (120) and a spring device (130) that extend from and are integrally formed in one piece with the holder portion (110), and the spring device (130) presses the clip connector (100) away from the electrical mating connector (300) when the clip connector (100) is incorrectly clipped to the mating connector (300), and when establishing the clip connection formed of the clip connector (100) and the mating connector (300), a flat plug sleeve (210) or a socket contact of the clip connector (100) can be received and is received successively with an interlocking fit in the mating connector (300) in at least two steps.

17. The electrical clip connection as claimed in claim 16, characterized in that the electrical mating connector (300) has an individual receiving chamber (310) for an individual electrical contact device (210), wherein the individual receiving chamber (310) has at least two centering devices (314, 315, 316, 317) for centering the contact device (210), wherein at least one electrical line (200) of the cable (20) can be provided at the holder portion (110) in such a way that an electrical contact device (210) of the line (200) protrudes freely from the holder portion, and the clip connector (1) can be assembled on the connection device (300) via the fastening portions (120).

18. The electrical clip connection as claimed in claim 17, characterized in that the individual receiving chamber (310) of the electrical mating connector (300) has a tubular design, at least internally, into which a seal (220) can also be advanced inwardly in addition to the electrical contact device (210) when establishing the clip connection.

* * * * *